US008552320B2

(12) United States Patent
Dellian

(10) Patent No.: US 8,552,320 B2
(45) Date of Patent: Oct. 8, 2013

(54) CONTROL OF ILLUMINATION DEVICES

(75) Inventor: Harald Dellian, Edling (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 603 days.

(21) Appl. No.: 12/742,651

(22) PCT Filed: Oct. 21, 2008

(86) PCT No.: PCT/EP2008/064169

§ 371 (c)(1),
(2), (4) Date: May 12, 2010

(87) PCT Pub. No.: WO2009/062816

PCT Pub. Date: May 22, 2009

(65) Prior Publication Data

US 2010/0264851 A1 Oct. 21, 2010

(30) Foreign Application Priority Data

Nov. 12, 2007 (DE) ..... 20 2007 015 713 U

(51) Int. Cl.
*H01H 1/56* (2006.01)

(52) U.S. Cl.
USPC ..... 200/509; 200/553

(58) Field of Classification Search
USPC ..... 200/509
See application file for complete search history.

(56) References Cited

U.S. PATENT DOCUMENTS

| | | | | |
|---|---|---|---|---|
| 3,204,070 | A | 8/1965 | Marano | |
| 3,382,339 | A | 5/1968 | Anderson | |
| 3,869,690 | A * | 3/1975 | Hickling | 337/390 |
| 5,051,607 | A | 9/1991 | Dalton | |
| 5,239,205 | A | 8/1993 | Hoffman et al. | |
| 6,700,225 | B1 | 3/2004 | Barmore | |
| 2009/0078556 | A1 * | 3/2009 | Huang | 200/553 |

FOREIGN PATENT DOCUMENTS

| | | |
|---|---|---|
| CH | 297 156 | 3/1954 |
| DE | 19 82 485 | 4/1968 |
| DE | 44 29 950 | 2/1996 |

* cited by examiner

*Primary Examiner* — R S Luebke
*Assistant Examiner* — Lheiren Mae Caroc
(74) *Attorney, Agent, or Firm* — Cozen O'Connor

(57) ABSTRACT

A switch for generating short-term supply-line interruptions during switching-on with contact elements (1, 2, 3, 5, 6, 21, 22, 23) and an actuating element (4) for opening and closing electrical contacts between the contact elements, wherein (1, 2, 3, 5, 6, 21, 22, 23). A first contact element (1, 5, 21) is mounted elastically and, when a contact is closed via the first contact element (1, 5, 21), can be deflected elastically in such a way that the contact, after initial closing, is opened again by the elastic deflection.

15 Claims, 3 Drawing Sheets

CONTROL OF ILLUMINATION DEVICES

RELATED APPLICATIONS

This is a U.S. national stage of application No. PCT/EP2008/064169, filed on Oct. 21, 2008.

This application claims the priority of German application no. 20 2007 015 713.4 filed Nov. 12, 2007, the entire content of which is hereby incorporated by reference.

FIELD OF INVENTION

Technical Field

This invention relates to the control of lighting devices by virtue of short-term supply-line interruptions.

BACKGROUND OF THE INVENTION

It is known in principle to use short-term power interruptions for driving an identification circuit in the electronic ballast of a lamp and for switching over between operating states when switching lamps and luminaires on and off. These operating states may be various dimming levels or the operation of various lamps in one luminaire.

For example, once the lamp or luminaire has been switched on, the user can switch off the lamp or luminaire briefly and switch it on again immediately in order to thus switch it from a low dimming level into a high dimming level and to switch it back again with a renewed identical operation.

SUMMARY OF THE INVENTION

One object of the present invention is to provide improved possibilities in this form of control of lighting devices.

This object is achieved by in accordance with one aspect of the present invention directed to a switch for generating short-term supply-line interruptions during switching-on with contact elements and an actuating element for opening and closing electrical contacts between the contact elements characterized by the fact that a first contact element is mounted elastically and, when a contact is closed via the first contact element, can be deflected elastically in such a way that the contact, after initial closing, is opened again by the elastic deflection.

Another aspect of the invention relates to lighting installations containing this switch with at least one lighting device.

Preferred configurations are given in the dependent claims. In the explanation of the invention and these configurations below, a distinction is no longer specifically drawn between the various categories of the claims, but the individual features relate to all categories of claims in each case.

The basic concept of the invention consists in providing a switch in which the short-term interruption in the power supply system can be brought about in a more simple manner, in particular without needing to return completely to the switch-off position and then to switch into the switch-on position. In this regard, the invention proposes elastic mounting of one of the contact elements, which is referred to as the first contact element here. By virtue of an elastic deflection of this first contact element when the electrical contact between said first contact element and another contact element and therefore the line is closed, the contact which has just been closed should be opened again as a result of the deflection. Then, the closed state of the line can be reproduced automatically or by virtue of a return actuating operation of the user, without the user needing to guide the switch back into the switch-off position for line interruption. The elastic deflection therefore replaces the short-term return to the switch-off position.

The elastic deflection can be brought about by a press-in movement which goes beyond a specific position, in which the contact is closed, i.e. by virtue of the user pressing a rocker switch surface or a pushbutton switch surface in particularly far, for example.

The further contact element which produces the described first contact with the elastically mounted contact element prior to the short-term line interruption is preferably a or the movable contact element of the switch, which is moved by an actuating element, for example a rocker-like actuating surface of a rocker switch. Preferably, the movable "second" contact element leads directly to the elastic deflection of the first contact element, and therefore impinges directly upon said first contact element and exerts the force (or transfers the force applied by the actuating element) for the elastic deflection.

In addition, the elastic mounting can be used for the restoring force for reproducing the contact. For this purpose, once the force transferred via the actuating element has diminished, the now sufficient restoring force can reproduce the open electrical contact, i.e. can bring the first contact element and the second contact element or a further "third" contact element towards one another. This can also take place automatically without the force which is exerted on the actuating element or the movable contact element necessarily diminishing.

In particular, such automatic restoring can be brought about by the second contact element sliding past the first contact element and the resultant release of the first contact element. The elastic restoring force can then move the released first contact element back into a contact position, in which said first contact element first again comes into contact with another part of the second or the third contact element.

This may result in difficulties owing to the first contact element impinging upon the third contact element, which difficulties can be avoided or at least improved by virtue of the third contact element likewise being mounted elastically and yielding slightly on impact. Bounce operations and unintentional further interruptions in the line can thus be avoided.

In preferred configurations of the invention, at least one of the contact elements moves on an arcuate path. In the case of the movable contact element, this may be, for example, a path in the form of a circular arc about an axis of rotation. In particular, the movable contact element can be configured as a rocker.

The first, elastically mounted contact element may be an element configured as a spring, in particular a spring metal sheet. That part of this first contact element which bears the contact then likewise moves on an arcuate path if another end of the spring metal sheet is mounted fixedly, wherein this arcuate path is not precisely circular.

The movable second contact element can also substantially be configured as a metal sheet piece, for example as a rocker.

The regions of the contact elements in which the electrical contact is closed and opened can be provided with projections made from a suitable material in order to improve resistance to arc erosion.

As has already been mentioned at the beginning, the switch according to the invention is suitable not only for lighting installations, i.e. for operating interconnected lamps or luminaires, in which different dimming levels can be switched through, but also for switching over between different lamps. This switching-over process can also include further electrical loads in addition to a lamp or more generally a lighting device, for example switching over between a bell function and a lighting function in the case of a bell system on a front door or actuation of the luminaire via the bell pushbutton during ringing or switching over to and between functions of a two-way intercom system.

The installation of the switch preferably relates to a short-term interruption of the phase line of a live line, generally including DC voltage supply. However, in principle, interconnections are also possible in which, for example, the neutral conductor is interrupted and a suitable identification circuit evaluates said neutral conductor. Such an identification circuit may be part of an electronic ballast, but may also be provided separately from said electronic ballast in order to drive lamps which do not require a ballast via a relay, for example.

DETAILED DESCRIPTION OF THE DRAWINGS

Figure 1:
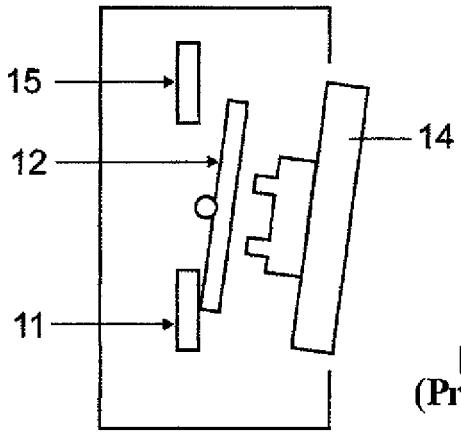
FIG 1 (Prior Art)
FIG. 1 shows a basic illustration of a conventional rocker switch in accordance with the prior art.

FIG. 1 shows a schematic sketch of a rocker switch with a rocker-like actuating surface 14, which can toggle about an axis of rotation in a manner which is not illustrated in detail. As a result, it can be switched from the position illustrated, in which the actuating surface points essentially from top right to bottom left in the section illustrated, into a position in which it points from top left to bottom right. Thus, in turn, the position of a likewise rocker-like contact element 12 is altered, with the result that it is possible to switch to and fro between a contact with a lower contact element 11 and an upper contact element 15.

In general, the end positions of the movement path of the actuating surface 14 and of the contact element 12 are stable and the positions therebetween are unstable. In other words, the switch is located in principle in one of the two end positions in the rest state.

In general, an incoming phase line is connected to the movable contact element 12 and two outgoing switched phase lines are connected to the two fixed contact elements 11 and 15, it being possible to switch to and fro between said phase lines. Alternatively, such changeover switches are often in practice also used for other applications, in which one of the two outputs remains open, for example the one corresponding to the fixed contact element 15. In this case, the switch would be in the switched-on state in the position shown in FIG. 1 and in the switched-off state in the alternative position.

In the applications known per se for driving operating states of lighting devices by short-term line interruptions, the user needs to switch back, for example, from the position illustrated to the opposite position and immediately back into the position illustrated in order to switch, for example, a lamp to a different dimming level. This can be perceived to be annoying, particularly if there are more than two operating states between which it is necessary to distinguish and which need to be switched through cyclically, for example. Alternatively or in addition, the prior art can therefore also be perceived to be disadvantageous because it makes certain demands of the motor control of the hand being used to actuate the switch and is virtually unusable for people with limited mobility of the hand, for example with certain diseases such as rheumatism, Parkinson's inter alia, for people with bandaged hands, for small children and in other situations.

Figure 2:
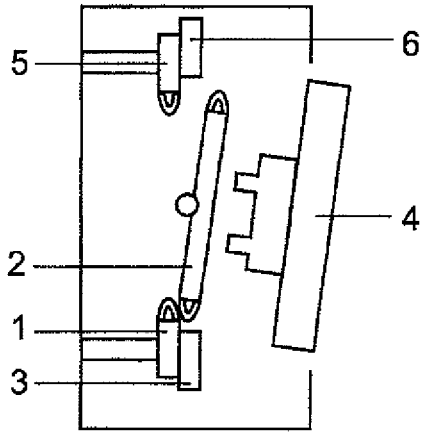
FIGS. 2 and 3 show a rocker switch according to an embodiment of the invention in a comparable illustration.
Figure 3:
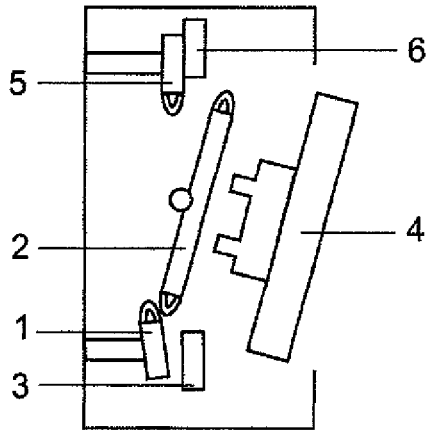

FIGS. 2 and 3 show the principle of a first exemplary embodiment. In this case, the two fixed contact elements 11 and 15 are replaced by elastically mounted contact elements 1 and 5. The horizontal bars in each case to the left of said contact elements are intended to represent the elastic mounting. These form "first" contact elements in the previous sense and bear against "third" contact elements 3 and 6 in the undeflected state.

The actuating surface is in this case denoted by the reference 4 but moreover corresponds to the actuating surface 14 shown in FIG. 1. It actuates a movable contact element 2, which likewise largely corresponds to FIG. 1 and, using the previous choice of wording, forms a "second" contact element. In the illustration in FIG. 2, there is the electrical contact between the second contact element 2 and the first contact element 1 and between said first contact element 1 and the third contact element 3, which is connected to the output line.

FIG. 3 illustrates that the actuating surface 4 can be pressed in further, for example when moved into the position illustrated in FIG. 2 from the opposite position. In this case, the user can press the actuating surface 4 further inwards with a slightly increased force, which likewise presses the second movable contact element 2 further inwards and therefore removes the two contact elements 1 and 3 from the position shown in FIG. 2, by virtue of the first contact element 1 being deflected elastically towards the left. If it is assumed that a switch-on operation is taking place, the state illustrated in FIG. 2 of an electrical short between the first, second and third contact elements 1, 2 and 3, respectively, is therefore only temporary and is removed by a situation in which, as in FIG. 3, there is an electrical contact between the first and the second contact element 1 and 2, respectively, but not between the first contact element 1 and the third contact element 3. The feed line of the power supply system is thus interrupted.

If the increased force for depressing the actuating surface 4 is only applied briefly, for example by virtue of the actuating surface 4 being immediately released after switchover, the elastic restoring force presses the first contact element 1 back into the bearing arrangement against the third contact element 3 and the second movable contact element 2 into the position shown in FIG. 2. The feed line of the power supply system is thus closed again.

An entirely similar operation can take place with the contact elements 5 and 6 corresponding to the contact elements 1 and 3, with the result that the basic suitability of the switch as a connector and a disconnector for two alternative outputs and as a changeover switch is maintained.

The first contact elements 1 and 5 are held, as shown at the bottom left in FIG. 3, in such a way that the first contact element moves on an arcuate path with its contact tip during the deflection. The contact tip of the second contact element moves on a circular path. The two in the process slide along one another, and therefore contact projections are indicated here which are made from a suitable material, not only in terms of spark erosion, but also have a rounded shape, and therefore a shape which is suitable for this sliding operation.

Figure 4:
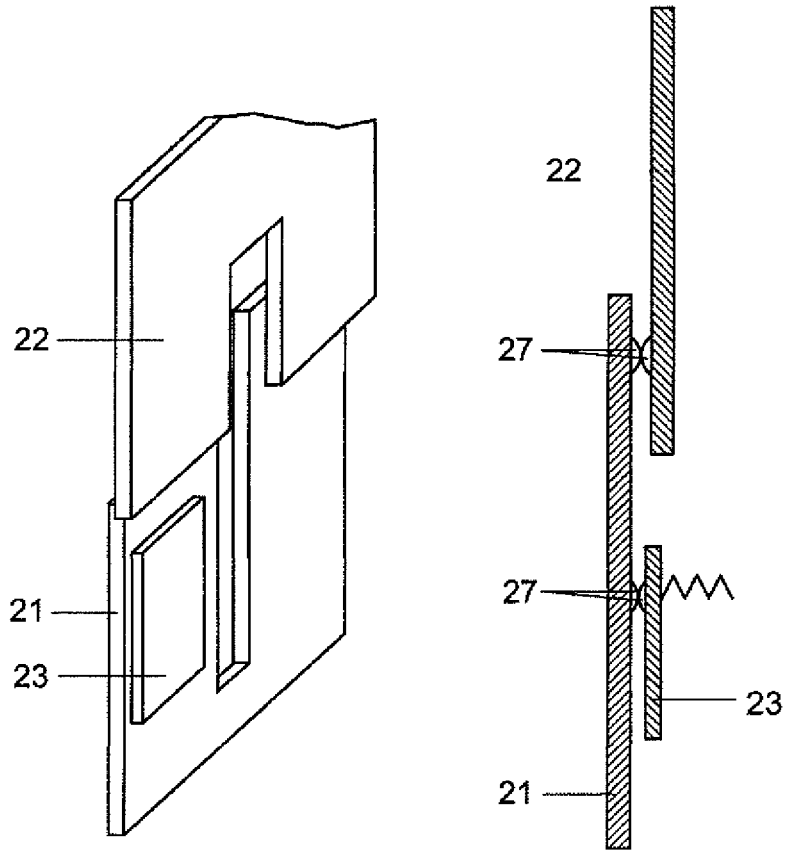
FIG. 4 shows a schematic of the design of various contact elements of a rocker switch according to the invention in accordance with a second exemplary embodiment.

A second exemplary embodiment is shown in FIG. 4 only as a detail (corresponding to the lower region of FIGS. 1-3) and as a slightly more specific illustration. In said figure, a first, second and third contact element are denoted by the reference symbols 21, 22 and 23. They are each in the form of metal sheets. The illustration on the left shows them in a perspective view, and the illustration on the right shows them in section.

The second contact element 22, as illustrated, has a substantially inverted U-shape, with the part illustrated meaning the lower part of a rocker-like contact element, which has a similar configuration to that in FIGS. 1-3, namely is configured to be mirror-symmetrical towards the top, i.e. in the form of an H.

In turn, the first contact element 21 has an upright U-shape with limbs of different lengths, with the left-hand, front limb being slightly shorter than the right-hand rear limb. Thus, the overlap, when viewed in the horizontal direction, between the left-hand, front limb of the first contact element 21 and of the second contact element 22 is much smaller than that between the respective right-hand rear limbs.

The first contact element 21 and the third contact element 23 are each mounted fixedly at their lower end in a manner which is not illustrated and are each in the form of spring metal sheets. As regards the third contact element 23, said contact element is symbolized in the illustration on the right by the helical spring indicated. The third contact element 23 can naturally also be considerably longer than is illustrated.

In this case too, projections formed in terms of spark erosion are provided which are denoted as a whole by 27.

If, ultimately, an electrical connection is intended to be produced between the second contact element 22 and the third contact element 23, the second contact element 22 moves into the position illustrated in the figures in a similar way to that shown in FIGS. 2 and 3. If an actuating surface is pressed in further, the second contact element 22 is moved further towards the left beyond the position illustrated, with the left-hand, front limb no longer pressing the left-hand, front limb of the first contact element 21 in front of it after a certain angle and therefore becoming detached from the third contact element 23, but sliding beyond said third contact element 23. Thereupon, the first contact element 21 can spring back elastically and again produce a contact with the third contact element 23, the contact between the right-hand, rear limb of the second contact element 22 and that of the first contact element 21 remaining in place. Thus, only a short-term interruption is therefore also provided when the user presses the actuating surface in far for a relatively long period of time. In contrast to the first exemplary embodiment, the interruption time is only dependent on the speed of the pressing-in operation, no longer on the duration. After release of the actuating surface, the second contact element 22 again moves back into the position in FIG. 4 and in the process again slides over the limb of the first contact element 21.

Figure 5:
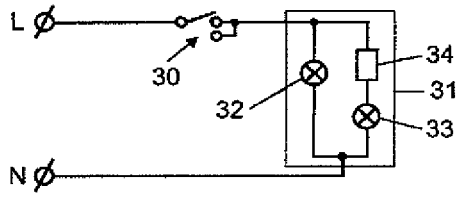
FIGS. 5-8 show four different lighting installations according to the invention as further exemplary embodiments.

FIGS. 5-8 show various exemplary lighting installations for illustrating possible applications of the switch according to the invention. FIG. 5 shows the switch, denoted by 30, in the phase feed line L of a luminaire 31. The luminaire 31 contains two light-emitting means 32 and 33 and an evaluation electronics unit 34, which can identify the short interruption in the system current when the switch 30 according to the invention is pressed far in and is preferably part of a lamp ballast. The light-emitting means 32 is always switched on when the phase is applied, but the light-emitting means 33 is only switched on when the evaluation electronics unit 34 identifies the short-term interruption to the power supply system. This can be interpreted as switching over between dimming levels of the entire luminaire. At one dimming level, the two light-emitting means are running, but in another dimming level only one light-emitting means is running. In addition, it is naturally also possible to switch between dimming levels of the lamps, with a corresponding "switch-through sequence" of the luminaire overall being produced.

Figure 6:
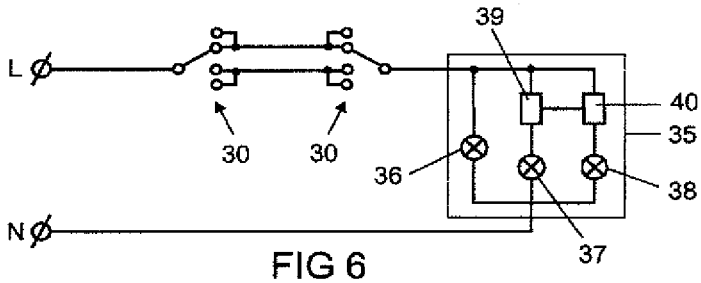

The embodiment shown in FIG. 6 is constructed on this basis and shows the switch 30 according to the invention with an identical design also being implemented as a changeover switch. A luminaire 35 contains three light-emitting means 36-38 and, either in the ballasts or separately, two evaluation electronics units 39 and 40, which communicate with one another, as indicated by the horizontal line. The light-emitting means 36 is always switched on. After a first, short interruption to the power supply system, the evaluation electronics unit 39 identifies this interruption and drives the light-emitting means 37. At the same time, it enables the second evaluation electronics unit 40, which switches on the second light-emitting means 38 after a further short-term interruption to the power supply system. In a further configuration, the first evaluation electronics unit 39 could thereafter switch off the first light-emitting means 37 in the event of a further short-term interruption to the power supply system and the second evaluation electronics unit 40 could switch off the second light-emitting means 38 in the event of a fourth short-term interruption to the power supply system. Alternatively, both light-emitting means 37 and 38 could also be switched off in the event of the third interruption to the power supply system.

Figure 7:
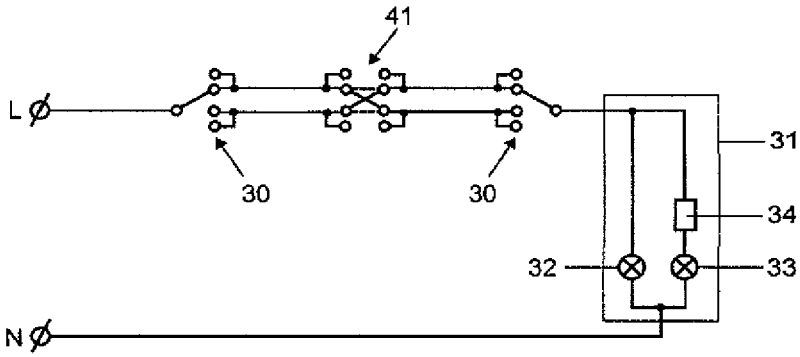

In FIG. 7 there is a so-called intermediate switch circuit. In this intermediate switch circuit, changeover switches 30 according to the invention are present on the left and the right, as in FIGS. 5 and 6. In addition, an intermediate switch 41, which is likewise equipped according to the invention at the contacts, is provided in the center. The graphical illustration already indicates the operation of said intermediate switch: in one switching position, it connects the contacts illustrated in diagonal opposition (i.e. top left with bottom right and bottom left with top right), and in the other switching position (illustrated by dashed lines) it connects the contacts illustrated so to speak in parallel (i.e. top left with top right and bottom left with bottom right). It can easily be seen that each actuation of one of the switches 30, 41 therefore indicates a switch-on or switch-off actuation of the entire installation. The same applies to the short-term interruptions to the power supply system in accordance with the invention. Moreover, if more than three operating positions are desired, it is also possible to use as many more intermediate switches 41 as desired. The luminaire 31 on the right corresponds to the exemplary embodiment shown in FIG. 5.

Figure 8:
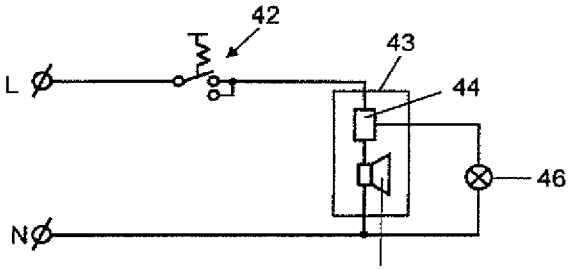

Finally, FIG. 8 shows a final exemplary embodiment, to be precise a bell installation in a house. A momentary contact switch 42 configured according to the invention is provided in one branch of a low-voltage DC voltage supply. 43 denotes a doorbell system equipped with a corresponding evaluation electronics unit 44, 45 denotes the bell itself and 46 denotes a luminaire.

If a short interruption to the power supply system during switch-on is produced with the momentary contact switch 42 according to the invention, this is identified by the evaluation electronics unit 44 and drives door lighting 46 instead of the bell 45. If the momentary contact switch is actuated without being pressed far in, however, the bell 43 is sounded as normal. In addition, further bells and/or luminaires could also be provided, as a result of which a corresponding switch-through sequence would again result.

The invention claimed is:

1. A switch for generating short-term supply-line interruptions during switching-on with contact elements and an actuating element for opening and closing electrical contacts between the contact elements, wherein a first contact element is mounted elastically and, when a contact is closed via the elastically mounted first contact element, can be deflected elastically in such a way that the contact, after initial closing, is opened again by the elastic deflection, wherein the actuating element can move a movable second contact element, the second contact element can deflect the elastically mounted first contact element, and the elastically mounted first contact element, in the state in which it is not elastically deflected, makes contact with a third contact element, from which it can be moved away during the elastic deflection.

2. The switch as claimed in claim 1, wherein an elastic restoring of the elastically mounted first contact element after opening the contact by virtue of the elastic deflection closes the contact again.

3. The switch as claimed in claim 1, wherein the actuating element can be pressed in, via the elastically mounted first contact element, in order to close the contact and can be pressed in beyond a closing position, in which the contact is closed, as a result of which the elastically mounted first contact element is deflected.

4. The switch as claimed in claim 3, wherein the movable second contact element can deflect the elastically mounted first contact element and in the process slide past the elastically mounted first contact element, with the result that the elastically mounted first contact element springs back elastically and closes the contact again before the second contact element is moved back.

5. The switch as claimed in claims 4, wherein the third contact element is likewise mounted elastically in order to ensure bounce-free closing after an elastic springback.

6. The switch as claimed in claim 1, wherein at least one of the contact elements moves on an arcuate path.

7. The switch as claimed in claim 1, wherein at least one of the contact elements moves on an arcuate path, and wherein the movable second contact element is a rocker.

8. The switch as claimed in claim 1, wherein the elastically mounted first contact element is a spring metal sheet, and the elastic mounting follows from elastic properties of the spring metal sheet.

9. The switch according to claim 1, wherein the elastically mounted first contact element is a spring metal sheet, and the elastic mounting follows from elastic properties of the spring metal sheet, and wherein the movable second contact element and the elastically mounted first contact element are each metal sheet pieces.

10. The switch as claimed in claim 1, wherein projections are provided on the contact elements in order to improve an erosion resistance in a contact region.

11. The switch as claimed in claim 1, wherein the switch is configured as a light switch for building lighting.

12. A lighting installation comprising at least two loads of which at least one is a lighting device, and a switch according to claim 1, wherein the lighting installation is adapted to switch over between the loads by the switch by virtue of short-term supply-line interruptions as a result of elastic deflection of the elastically mounted first actuating element.

13. A lighting installation as claimed in claim 12, comprising at least one lighting device, which can be operated at different dimming levels, wherein the lighting installation is designed to switch over between dimming levels by the switch by virtue of short-term supply-line interruptions as a result of elastic deflection of the elastically mounted first actuating element.

14. The lighting installation as claimed in claim 12, wherein the lighting device has an electronic ballast, which contains an identification circuit for identifying the short-term supply-line interruptions.

15. The lighting installation as claimed in claim 12, in which a live line is interrupted.

* * * * *